US008323057B2

(12) United States Patent
Ho

(10) Patent No.: US 8,323,057 B2
(45) Date of Patent: Dec. 4, 2012

(54) RECEPTACLE CONNECTOR

(75) Inventor: Yi-Tse Ho, Taipei Hsien (TW)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 13/209,991

(22) Filed: Aug. 15, 2011

(65) Prior Publication Data

US 2012/0040567 A1 Feb. 16, 2012

(30) Foreign Application Priority Data

Aug. 13, 2010 (TW) ..... 99215618 U
Aug. 13, 2010 (TW) ..... 99215619 U
Aug. 13, 2010 (TW) ..... 99215620 U

(51) Int. Cl.
*H01R 24/00* (2011.01)

(52) U.S. Cl. ..... 439/660; 439/607.4

(58) Field of Classification Search ..... 439/660, 439/607.4, 79

See application file for complete search history.

(56) References Cited

U.S. PATENT DOCUMENTS 7,572,146 B1 * 8/2009 Chiang ..... 439/607.01
8,215,996 B2 * 7/2012 Su et al. ..... 439/660

* cited by examiner

*Primary Examiner* — Phuong Dinh
(74) *Attorney, Agent, or Firm* — Stephen L. Sheldon

(57) ABSTRACT

A receptacle connector, comprising a housing, a tongue unit, a first terminal set, a second terminal set, a third terminal set and a shield. The housing comprises a base and an assembly slot on the base. The tongue unit is assembled in the assembly slot and includes a main body and an enhanced wall. The main body has a plug in part placed on the front and back and an assembly part combined with the assembly slot. The enhanced wall is located between the plug in part and the assembly part. Each of the first terminals may have a first contact part that exposes the upper surface of the main body and a first fixed part that extends backward from the first contact part and whose front section is disposed within the main body and whose rear section bends and is disposed within the enhanced wall.

12 Claims, 15 Drawing Sheets

RECEPTACLE CONNECTOR

RELATED APPLICATIONS

This application claims priority to Taiwan Application No. 99215619, filed Aug. 13, 2010, to Taiwan Application No. 99215618, filed Aug. 13, 2010, and to Taiwan Application No. 99215620, filed Aug. 13, 2010, all of which are incorporated herein by reference in their entirety.

TECHNICAL FIELD

The present invention relates to a receptacle connector and in particular, to a receptacle connector with a tongue.

BACKGROUND ART

To meet user needs for multiple functions and compactness, the compound electric connector that meets a plurality of signal transmission protocols have become a trend in the development of electric connectors. In particular, signal transmission protocols are constantly updated. During the transitional period between new and old transmission protocols or between multiple and different signal transmission protocols, compound electric connectors that simultaneously comply with multiple transmission protocols are more convenient to use.

Currently, common signal transmission protocols are USB 2.0, USB 3.0 (USB is an abbreviation for Universal Serial Bus) and ESATA (which is an abbreviation of External Serial Advanced Technology Attachment). Therefore, compound electric receptacle connectors that are available for separately plugging in USB 2.0, USB 3.0 and ESATA receptacle connectors have been developed. For example, some have been disclosed by Taiwan New Patent Public Bulletin Number M357748 (corresponding Chinese patent application number 200810173163.4; corresponding United States Patent Publication Number US 2009111330A1). A preferred embodiment disclosed by patent number M357748 is an assembled structure that uses a detached tongue and comprises three types of terminals, wherein the first type of terminals are ESATA connector terminals. The second type of terminals are standard USB 2.0 connector terminals. The third type of terminals combine with the second type of terminals to jointly form USB 3.0 connector terminals. The third type of terminals and the tongue are integrally formed and disposed in the tongue and are roughly located in the middle of the tongue. The first type of terminals is installed on the upper surface of the tongue. The second type of terminals is installed on the lower surface of the tongue.

However, its tongue is a flat and straight plate body. The tongue is only connected to and fastened onto the insulating body through a fastening structure. The stability of the assembled combination is a concern and the tongue itself is structurally rather weak because it is rather thin. To install the second type of terminals, a terminal path is formed on the tongue that runs through the rear end of the tongue, thus leaving the strength of the tongue even more insufficient and making it harder to withstand the high plug in force or torque or an abnormal plug in state, and easily causing conditions the as a loose and broken tongue, etc.

SUMMARY OF THE INVENTION

A receptacle connector comprises a housing, a tongue unit, a first terminal set, a second terminal set, a third terminal set and a shield placed outside the housing. The housing comprises a base and an assembly slot placed on the base. The tongue unit is assembled in the assembly slot of the housing, comprising a main body and an enhanced wall. The main body has a plug in part placed on the front and back and an assembly part combined with the assembly slot. The enhanced wall is located between the plug in part and the assembly part and extends in a direction perpendicular to the main body. Each of the first terminals has a first contact part that exposes the upper surface of the main body and a first fixed part that extends backward from the first contact part and whose front section is disposed within the main body and whose rear section bends and is disposed within the enhanced wall. The second terminal set is placed on the housing and the tongue unit and each of the second terminals has a second elastic contact part that is located on the upper surface of the main body of the tongue unit to the rear of the first contact part. The third terminal set is placed on the housing and the tongue unit and each of the third terminals has a third contact part placed on the lower surface of the main body of the tongue unit.

BRIEF DESCRIPTION OF THE DRAWINGS

The provided disclosure is illustrated by way of example and not limited in the accompanying figures in which like reference numerals indicate similar elements and in which.

DETAILED DESCRIPTION OF THE PREFERRED EMBODIMENTS

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity. In certain embodiments, the tongue unit has an enhanced wall that extends in a direction perpendicular to the main body and the first affixed part of the first terminals is disposed within the main body and the enhanced wall in an L shape, thus enhancing the strength of the tongue unit itself. In addition, the enhanced wall can be set against the base seat, thus enhancing the assembly combination strength and stability of the tongue unit and housing.

Figure 1:
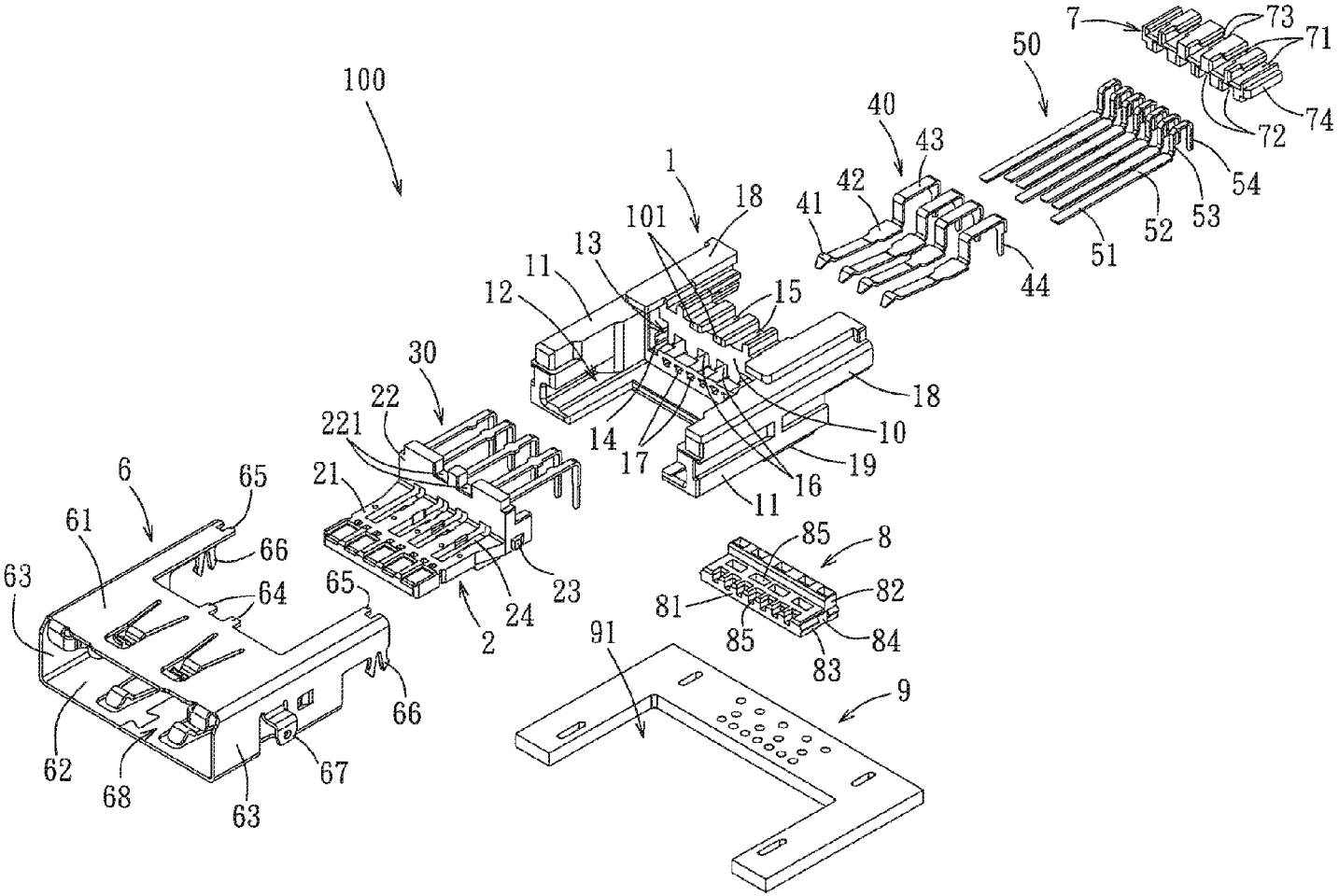
FIG. 1 is a perspective exploded view of an embodiment of a receptacle connector.
Figure 2:
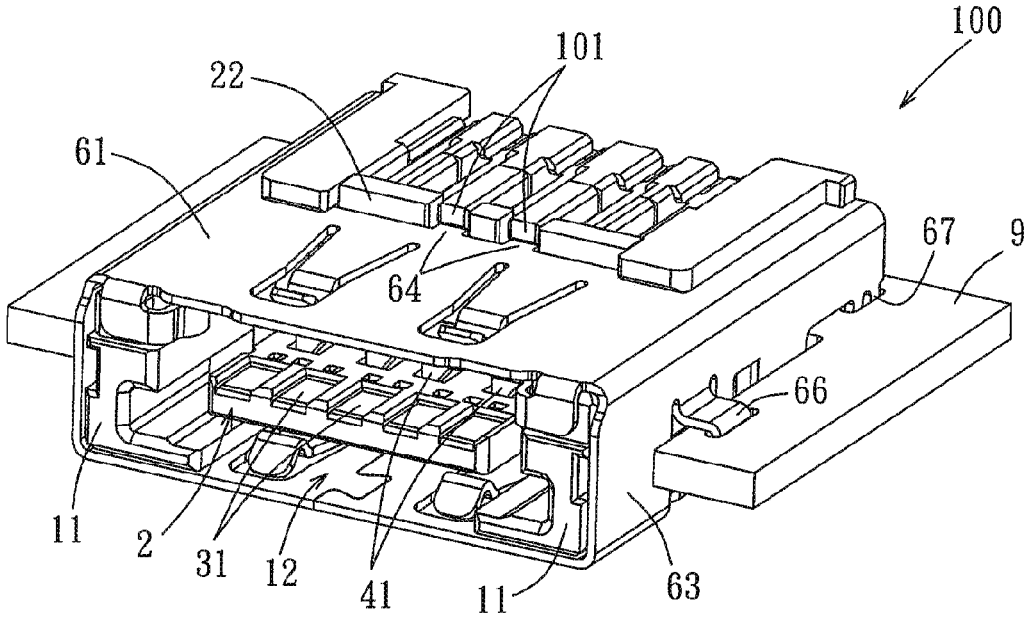
FIG. 2 is an assembled view of the embodiment depicted in FIG. 1.
Figure 3:
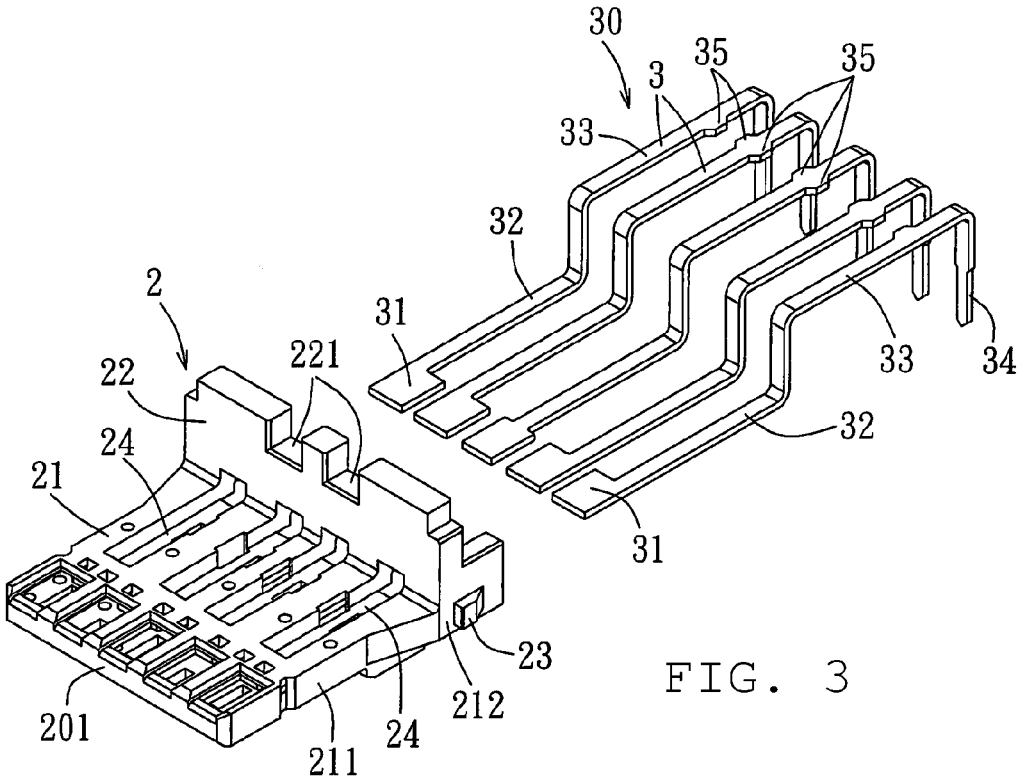
FIG. 3 is a perspective exploded view, describing a tongue played unit and a terminal set.

Refer to FIG. 1, FIG. 2 and FIG. 3. An embodiment of receptacle connector 100 is suitable for installation on a circuit board 9 with gap 91. Receptacle connector 100 comprises: an housing 1, a tongue unit 2, a first terminal set 30, a second terminal set 40, a third terminal set 50, a shield 6, a first positioning part 7 and a second positioning part 8.

Housing 1 comprises a base 10 and arms 11 that respectively extend forward from the two opposite sides of base 10. Shield 6 slides outside of insulating the body 1 and together with insulating body 1, jointly form an insertion space 12. That is, base 10 of housing 1 and shield 6 jointly form insertion space 12. Housing 1 also comprises assembly slot 13 that is placed on the two sides of base 10 and that sinks backward from adjacent insertion space 12.

Tongue unit 2 is assembled on housing 1, comprising a main body 21 and an enhanced wall. Main body 21 has a plug in part 211 placed on the front and back and an assembly part 212 combined with assembly slot 13. Enhanced wall 22 is located between plug in part 211 and assembly part 212 and extends upward in a direction perpendicular to main body 21. Assembled part 212 is installed in assembly slot 13 and plug in part 211 is located in insertion space 12. Tongue unit 2 also comprises a plurality of blocks 23 that are placed in assembled part 212 and that protrude and extend from both the left and right sides. Housing 1 also comprises a plurality of block slots 14 that are placed in assembly slot 13 of base 10, in order to respectively accommodate various blocks 23. Through the mutual clamping and fastening between blocks 23 and block slots 14, the bonding force between tongue unit 2 and housing 1 is enhanced.

Figure 14:
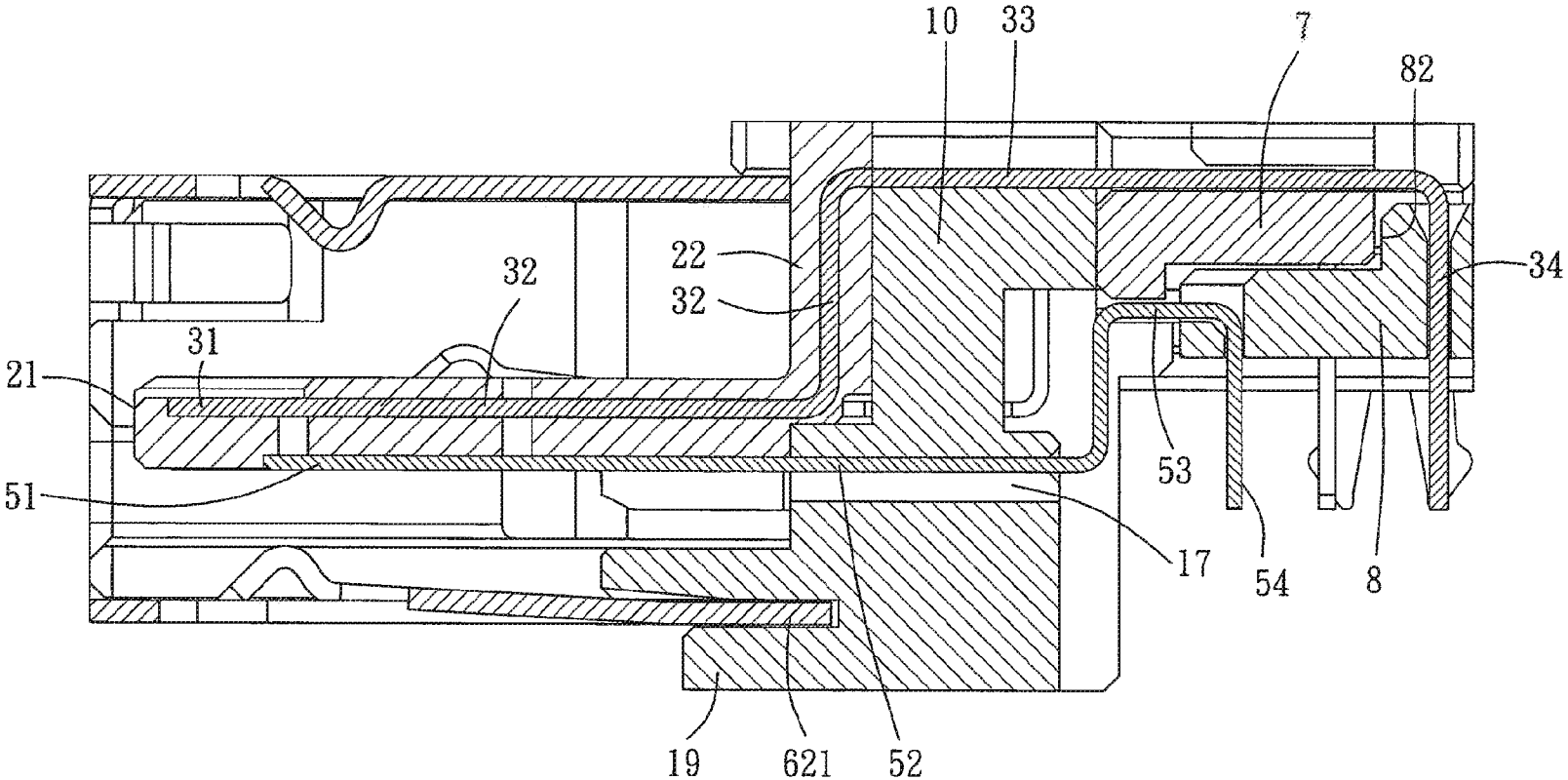
FIG. 14 is a cross-sectional view taken along IV-IV straight lines in FIG. 12.

Refer to FIG. 3, FIG. 4, FIG. 7, FIGS. 12 and 14. First terminal set 30 is placed on housing and tongue unit 2. Each of first terminals 3 has a first contact part 31 that exposes tongue unit 2 of the upper surface of main body 21 and that adjoins the front end, a first fixed part 32 that extends backward from first contact part 31 and whose front section is disposed within main body 21 and whose rear section bends and is disposed within enhanced wall 22, first extended part 33 that extends backward from fixed part 32 and out of enhanced wall 22, and a first guide and connecting part 34 that extends downward from first extended part 33. Through main body 21, which is roughly shaped as an L, and enhanced wall 22, the strength of the tongue unit itself may be enhanced and through first fixed part 32, which is roughly shaped as an L and which is disposed in main body 21 and enhanced wall 22, the strength of the tongue unit itself may be further enhanced. In addition, as shown in FIG. 14, the rear side of the enhanced wall 22 is set against base 10, thus increasing the assembly combination strength between tongue unit 2 and housing 1.

Figure 6:
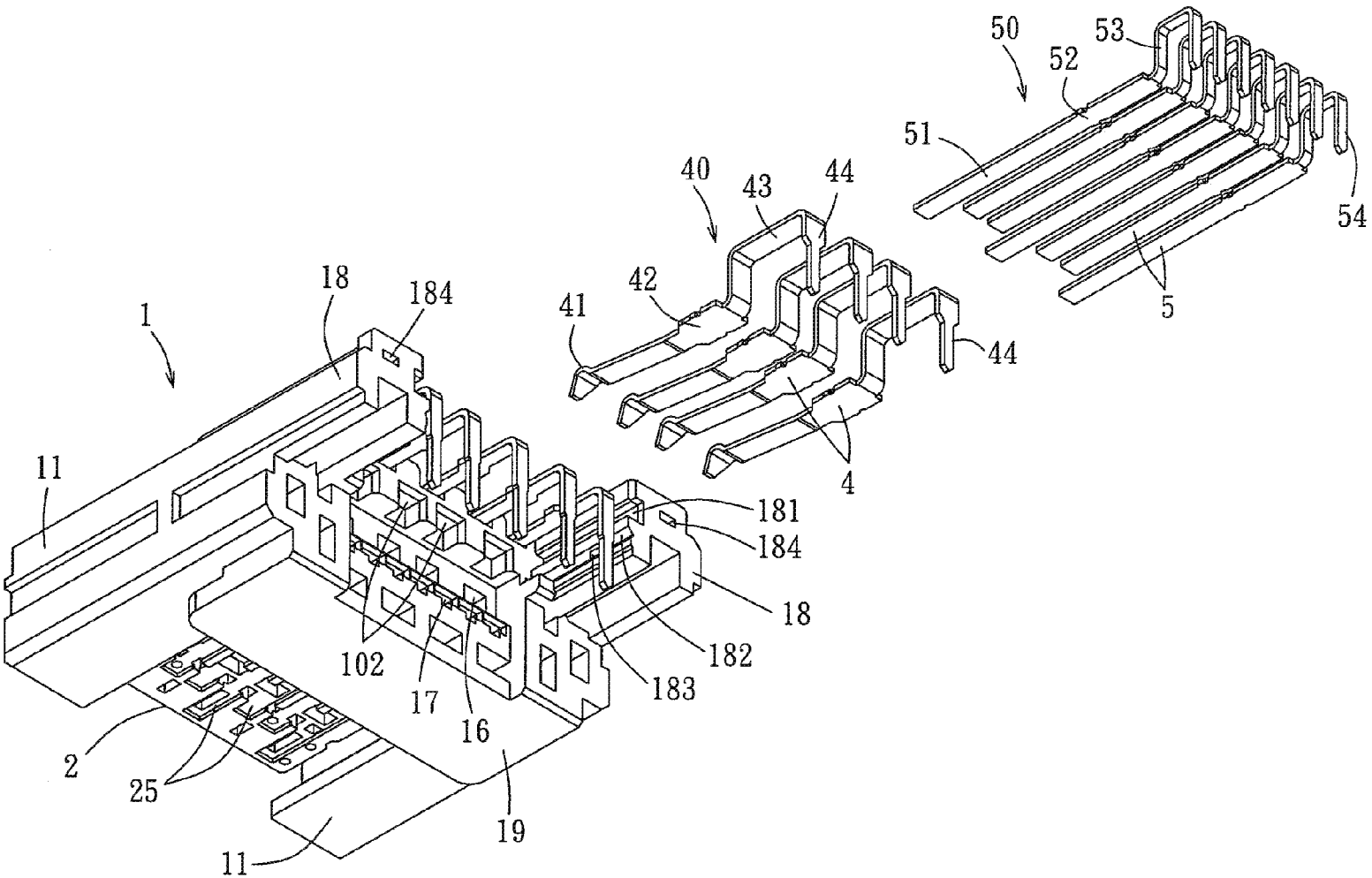
FIG. 6 is a combination view of FIG. 4 and a partial perspective exploded view of a second terminal set and a third terminal set.
Figure 7:
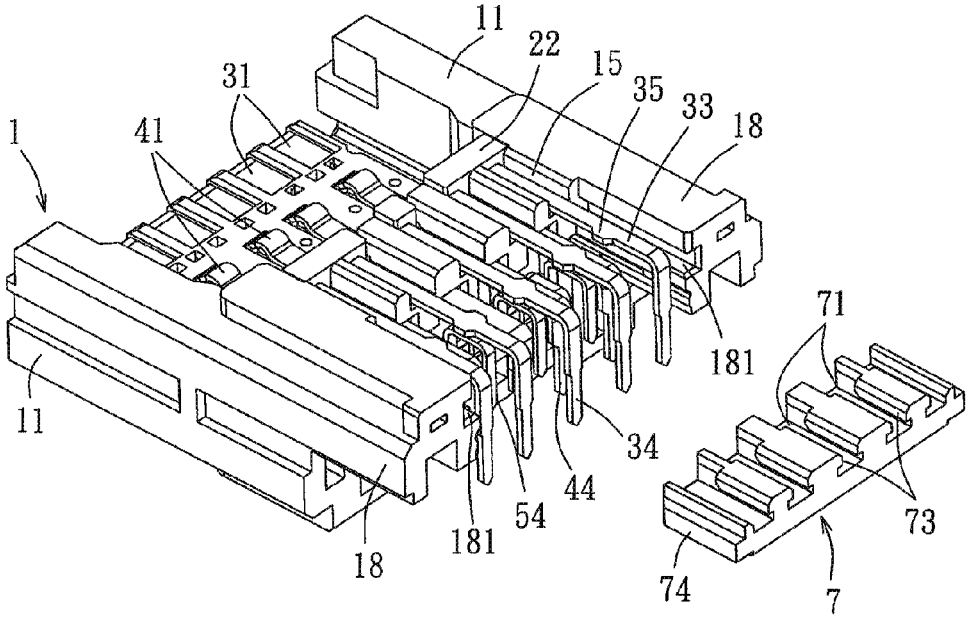
FIG. 7 is a combination view of FIG. 6 and a partial perspective exploded view of a first positioning part.
Figure 8:
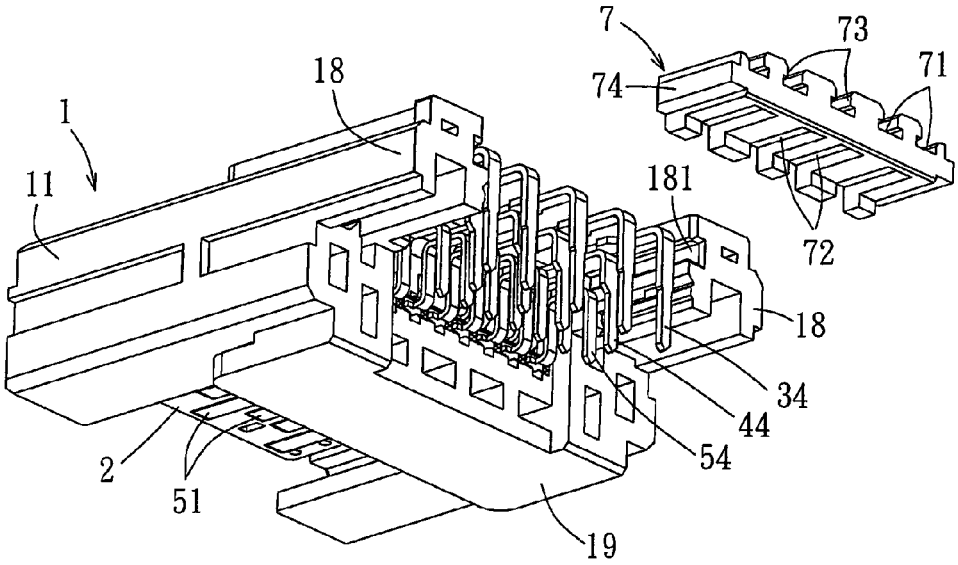
FIG. 8 is a view of FIG. 7 from another angle.
Figure 9:
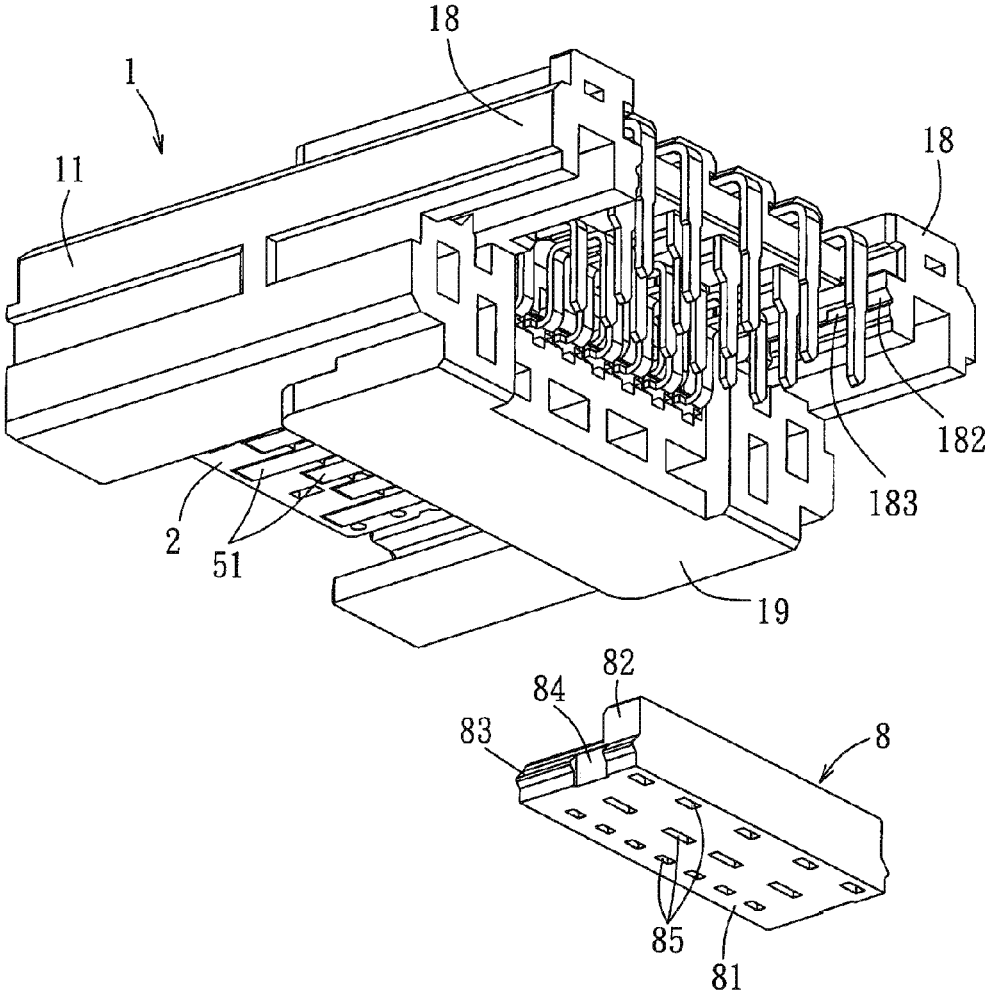
FIG. 9 is a combination view of FIG. 8 and a partial perspective exploded view of a second positioning part.
Figure 15:
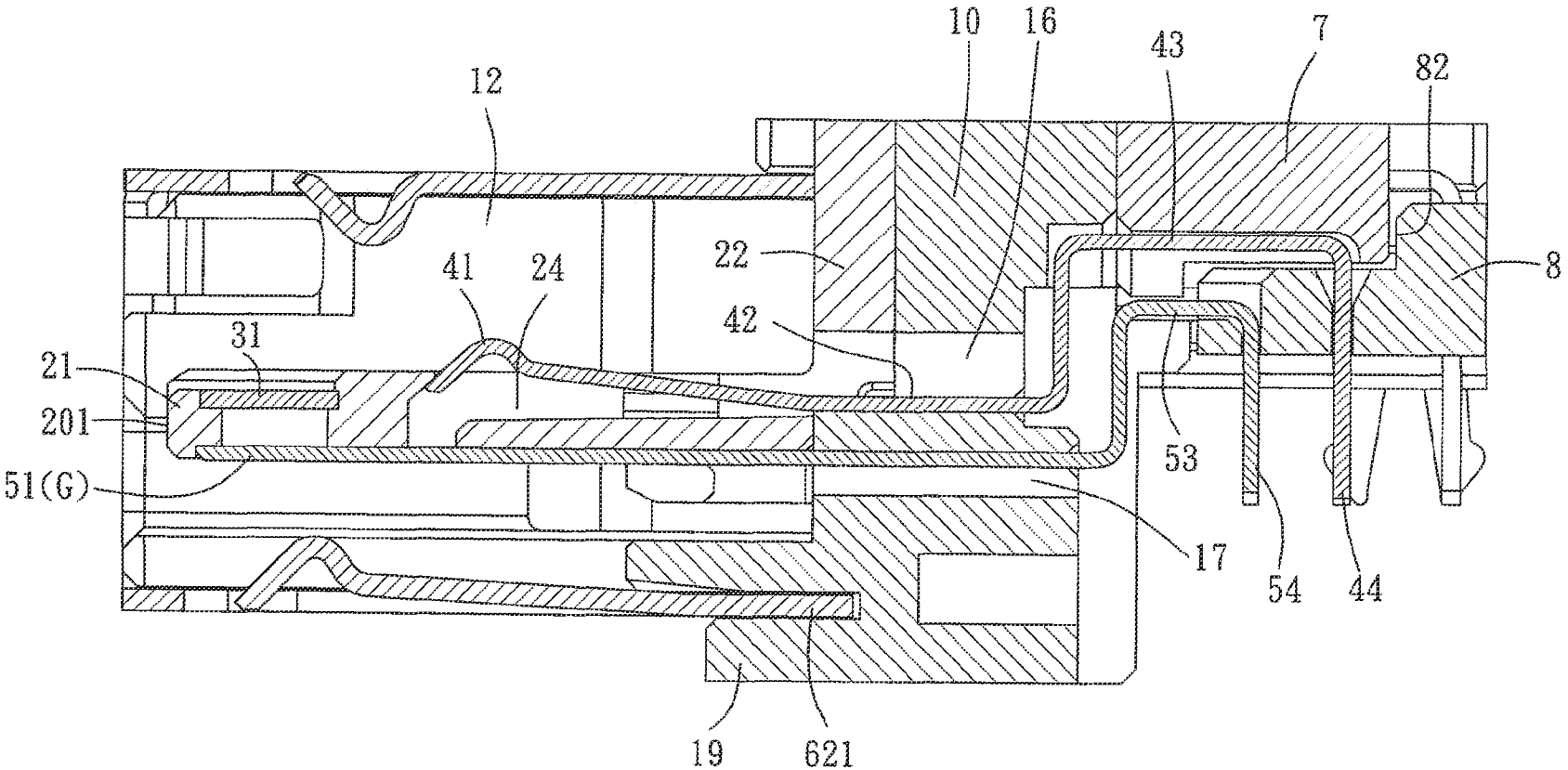
FIG. 15 is a cross-sectional view taken along V and is a and –V straight lines in FIG. 12.

Refer to FIG. 1, FIG. 6 and FIG. 15. Second terminal set 40 is placed on housing 1 and tongue unit 2 and each of second terminal 4 has a second elastic contact part 41 placed on the upper surface of main body 21 of tongue unit 2, a second fixed part 42 that extends backward from second elastic contact part 41, a second extended part 43 that bends and extends backward from second fixed part 42 (it first bends and extends, before bending and extending backward) and a second guide and connecting part 44 that extends downward from second extended part 43.

Refer to FIG. 1, FIGS. 6 and 14. Third terminal set 50 is placed on housing 1 and tongue unit 2 and each of the terminal 5 has a third contact part 51 placed on the lower surface of main body 21 of tongue unit 2, a third fixed part 52 that extends backward from third contact part 51, a third extended part 53 that bends and extends backward from third fixed part 52 (it first bends and extends, before bending and extending backward) and a second guide and connecting part 54 that extends downward from third extended part 53.

Figure 4:
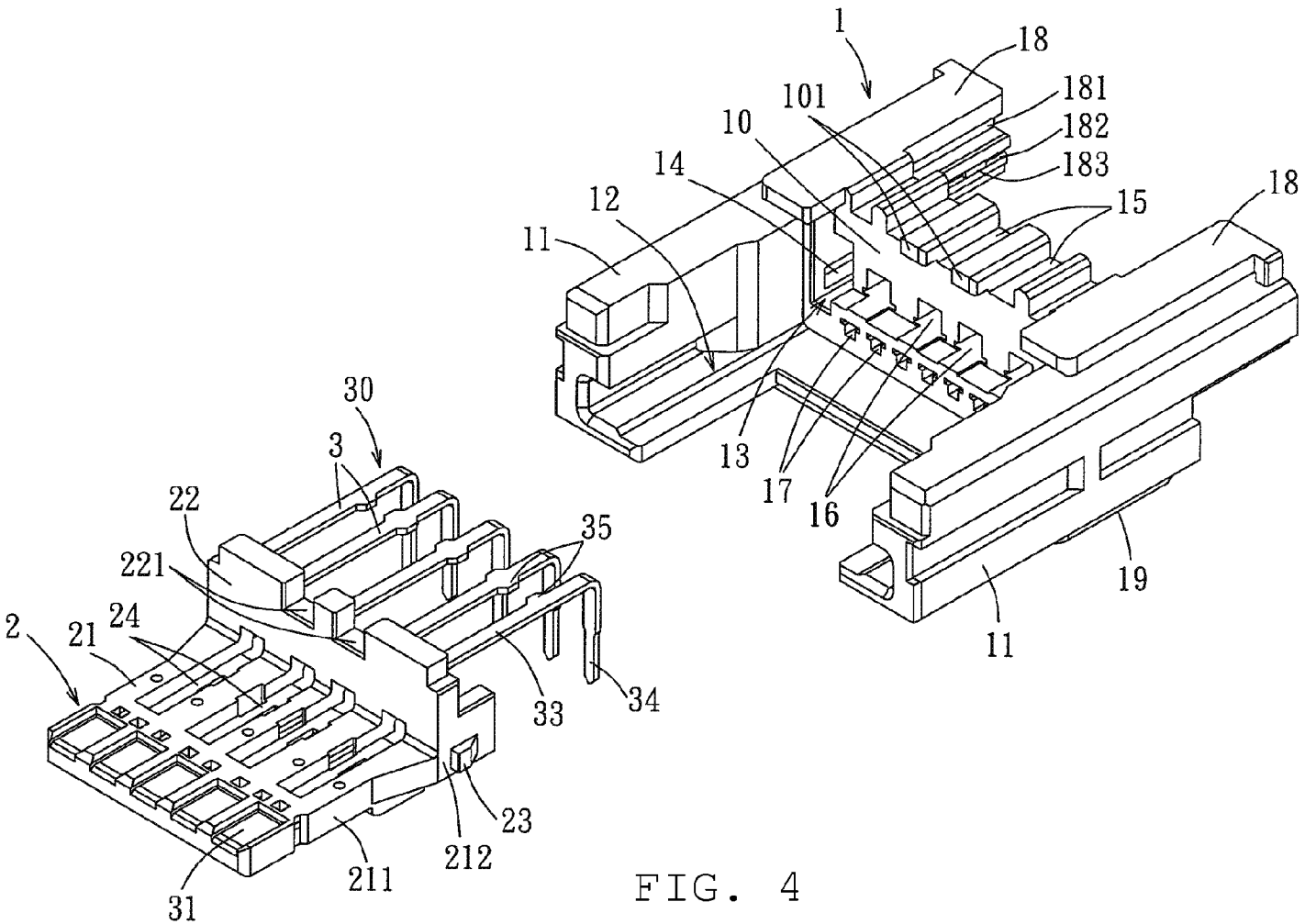
FIG. 4 is a perspective extruded view, describing an housing, a tongue played unit and a first terminal set.
Figure 5:
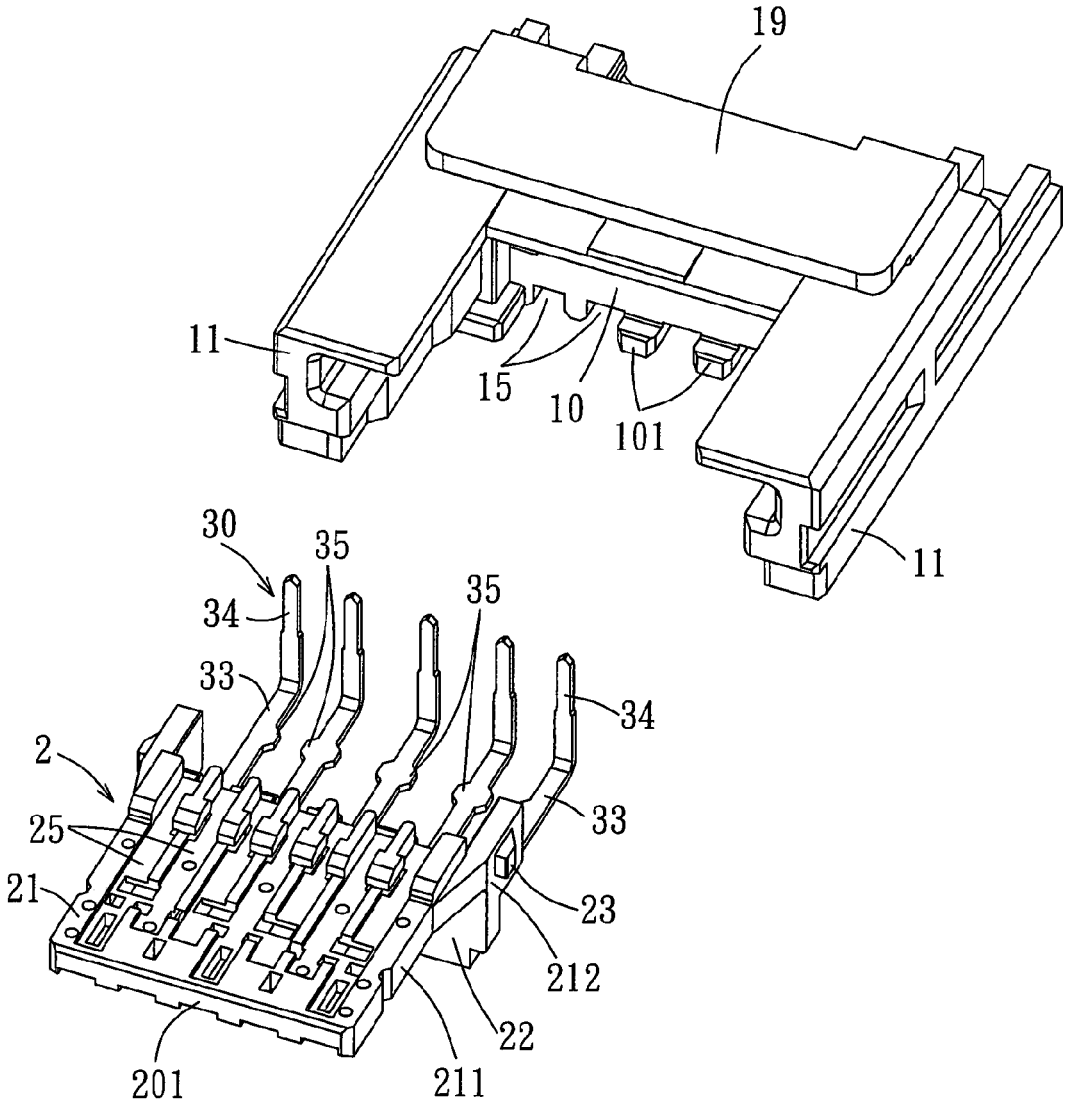
FIG. 5 is a view from another angle of FIG. 4.
Figure 16:
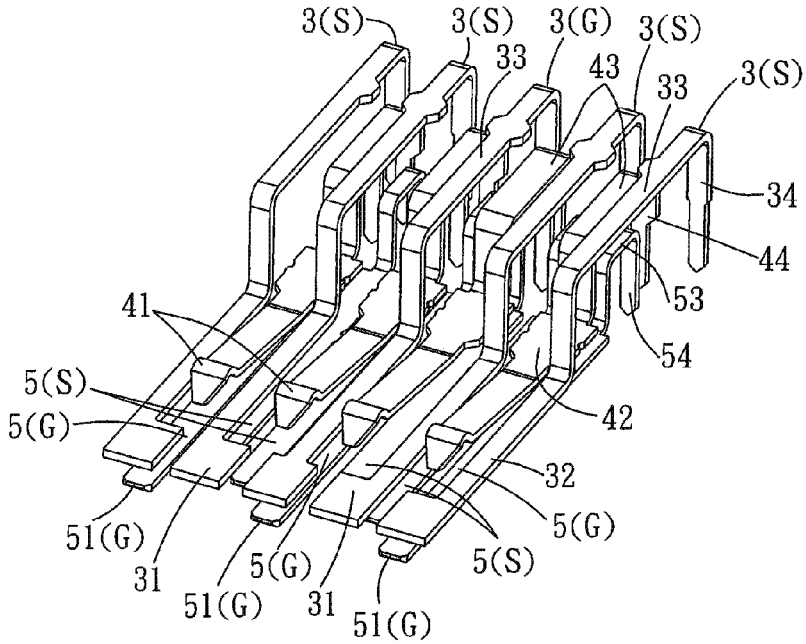
FIG. 16 is a perspective view, describing the position relationship among a first terminal set, a second terminal set and a third terminal set, wherein other components have been removed.
Figure 17:
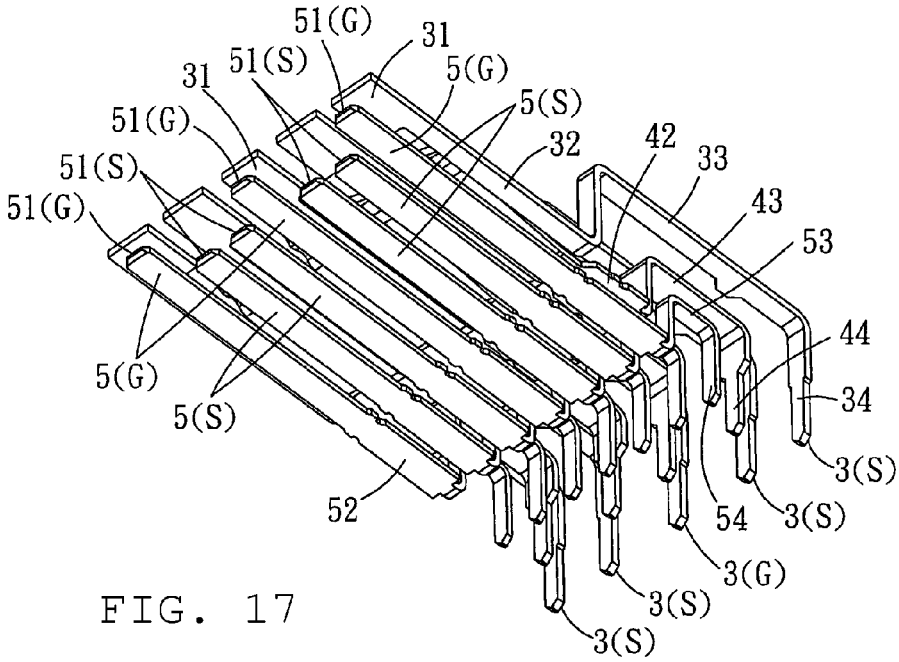
FIG. 17 is a view of FIG. 16 from another angle.
Figure 18:
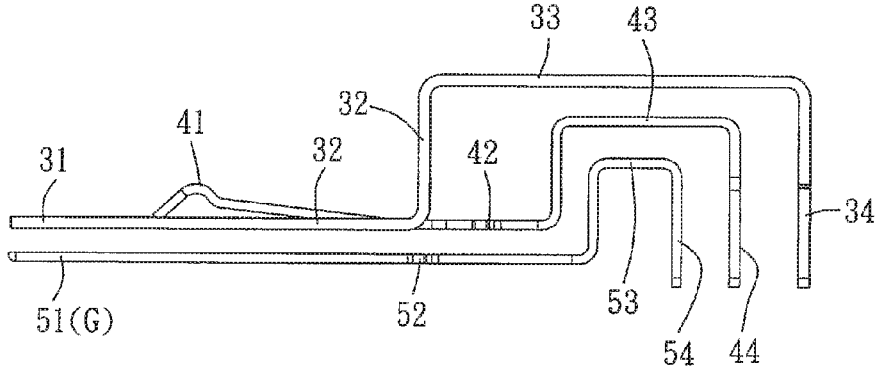
FIG. 18 is a side view of FIG. 16.

Refer to FIG. 3, FIG. 4, FIG. 5 and Six. The roof of housing 1 also comprises a plurality of first paths 15 that thread the front and back of base 10, in order to correspondingly thread various first extended parts 33, a plurality of second paths 16 that thread the front and back of base 10 and that are located below the first paths 15, in order to correspondingly thread various second terminals 4, as well as a plurality of third paths 17 that thread the front and back of base 10 and that are located below the second paths 16, in order to correspondingly thread the lower part of second terminals 5. Tongue unit 2 also comprises a plurality of second terminal slots 24 that are sunken into the upper surface of main body 21 and whose rear threads enhanced wall 22 and a plurality of third terminal slots 25 that are sunken into the lower surface of main body 21. Each of second terminal slots 24 is connected to the corresponding second paths 16 and each of the second terminal slots 24 is respectively located between two adjoining first fixed parts 32 and respectively and correspondingly accommodates each of the second elastic contact parts 41. Each of third terminal slots 25 is connected to the corresponding third paths 17 and respectively and correspondingly accommodates each of the third contact parts 51. Refer to FIG. 16, FIGS. 17 and 18. From the aforementioned description the location relationships among first terminals 3, second terminals 4 and third terminals 5 can be learned, wherein second extended parts 43 of second terminals 4 are located between first extended parts 33 of first terminals 3 and third extended parts 53 of third terminals 5. Second elastic contact part 41 of each of second terminals 4 threads between first fixed parts 32 of each of first terminals 3.

In the present embodiment, first terminal set 30 supports second terminal set 40 and is a terminal set used to transmit signals that comply with the USB 3.0 (USB refers to Universal Serial Bus) signal transmission protocol. Second terminal set 40 is a terminal set used to transmit signals that comply with USB 2.0 signal transmission protocol. Third terminal set 50 is a terminal set used to transmit signals that comply with ESATA (that is External Serial Advanced Technology Attachment) signal transmission protocol, wherein relative to first terminal set 30 and third terminal set 50, second terminal set 40 transmits low frequency signals. That is, relative to second terminal set 40, first terminal set 30 and third terminal set 50 transmit signals with relatively high frequencies. It has been described above that second extended parts 43 of second terminals 4 (which transmit low frequency signals) are located between first extended parts 33 of first terminals 3 (which transmit high frequency signals) and third extended parts 53 of third terminals 5 (which transmit high frequency signals). By placing second terminals 4 that transmit low frequency signals between first terminals 3 and third terminals 5 that transmit high frequency signals, the cross talking phenomenon caused by high frequency signal pairs (the as differential pair) can be reduced and the transmission impedance of signals can be stabilized, thus achieving the effect of stabilizing signal transmission.

In addition, refer to FIG. 16, FIG. 17 and FIG. 18 again. To explain the types of signals transmitted by various terminals, "G" is added after the label of each of the terminals to indicate grounded terminals and "S" indicates terminals that transmit signals. In the present embodiment, first terminal set 30 has a total of five first terminals 3, wherein the terminals located in the middle are the grounded first terminals 3 (G). Two pairs of first terminals 3 (S) that transmit signals are respectively located on the two sides of the grounded first terminals 3 (G). Third terminal set 50 has a total of seven third terminals 5, wherein the three located in the middle and the left and right outer sides are grounded third terminals 5 (G). Two pairs of third terminals 5 (S) that transmit signals are respectively located between the two adjoining grounded third terminals 5 (G). The front end of third contact part 51 (G) of the three grounded third terminals 5 (G) of third terminal set 50 protrudes forward more than third contact part 51 (S) of the four remaining third terminals 5 (S) that transmit signals and transcends the front end of first contact parts 31 of first terminals 3. With this, the grounded third terminals 5 (G) of the terminal set 50 can be closer to first contact parts 31 of first terminals 3 (S) (which transmit high frequency signals) of first terminal set 30 that transmit signals, thus being able to reduce the cross talking phenomenon of high frequency signal pairs and stabilizing the transmission impedance of signals and achieving the effect of stabilizing signal transmissions. Although in the present embodiment, the front end of the three grounded third terminals 5 (G) of third terminal set 50 (the front end of third contact parts 51 (G)) transcends the front end of first contact parts 31 of first terminals 3, it is also acceptable that the front end of the three grounded third terminals 5 (G) of third terminal set 50 is roughly lined up with the front end of first contact parts 31. That is, the front end of third contact parts 51 (G) of the three grounded third terminals 5 (G) of third terminal set 50 is not shorter than the front end of first contact parts 31 of first terminals 3. Refer to FIG. 15. If front end surface 201 of tongue unit 2 serves as the benchmark, the distance of the front end of third contact parts 51 (G) of the three grounded third terminals 5 (G) of third terminal set 50 from front end surface 201 of tongue unit 2 is not greater than the distance from the front end of first contact parts 31 to front end surface 201 of tongue unit 2.

Refer to FIG. 4, FIG. 6, FIG. 7, FIG. 8, FIG. 13 and FIG. 14. When first terminals 3 are molded into tongue unit 2, they are disposed and fixed in tongue unit 2 by insert molding. But first guide and connecting parts 34 are not yet bent (not shown in the figures) and instead extend backward in a straight line from first extended parts 33. When tongue unit 2 is assembled on base 10 from the front side of base 10, first guide and connecting part 34 and first extended parts 33 of the rear section are located on the rear side of base 10 by passing the corresponding first paths 15 and the front section of first extended parts 33 is located in first paths 15. Before second terminals 2 are assembled on insulating base body 1 and tongue unit 2, second guide and connecting parts 44 is not yet bent and instead extends backward in a straight line from first extended parts 43. Second terminals 4 are placed into correspondence second paths 16 from the rear side of base 10 and second elastic parts 41 and the second terminal slots 24 so second paths 16 and become ready for positioning. Second fixed parts 42 are located in second paths 16, where they are affixed through intervention. Second extended parts 43 are located on the rear side of second paths 16 and the vertical section of second extended parts 43 can be limited by limiting slots 102 on the rear side of base 10. Similarly, terminals 5 can also be placed into correspondence third paths 17 from the rear side of base 10 and the third contact part 51 enter third terminal slots 25 through third paths 17 and become ready for positioning. Third fixed parts 52 are located in third paths 17, where they are affixed through intervention. Third extended parts 53 are located on the rear side of the paths 17. Bending of third guide and connecting part 54 is already complete prior to assembly. After assembly of the terminals 3 is complete, bend second guide and connecting parts 44 and first guide and connecting part 34 is not bent until first positioning part 7 is assembled.

Figure 10:
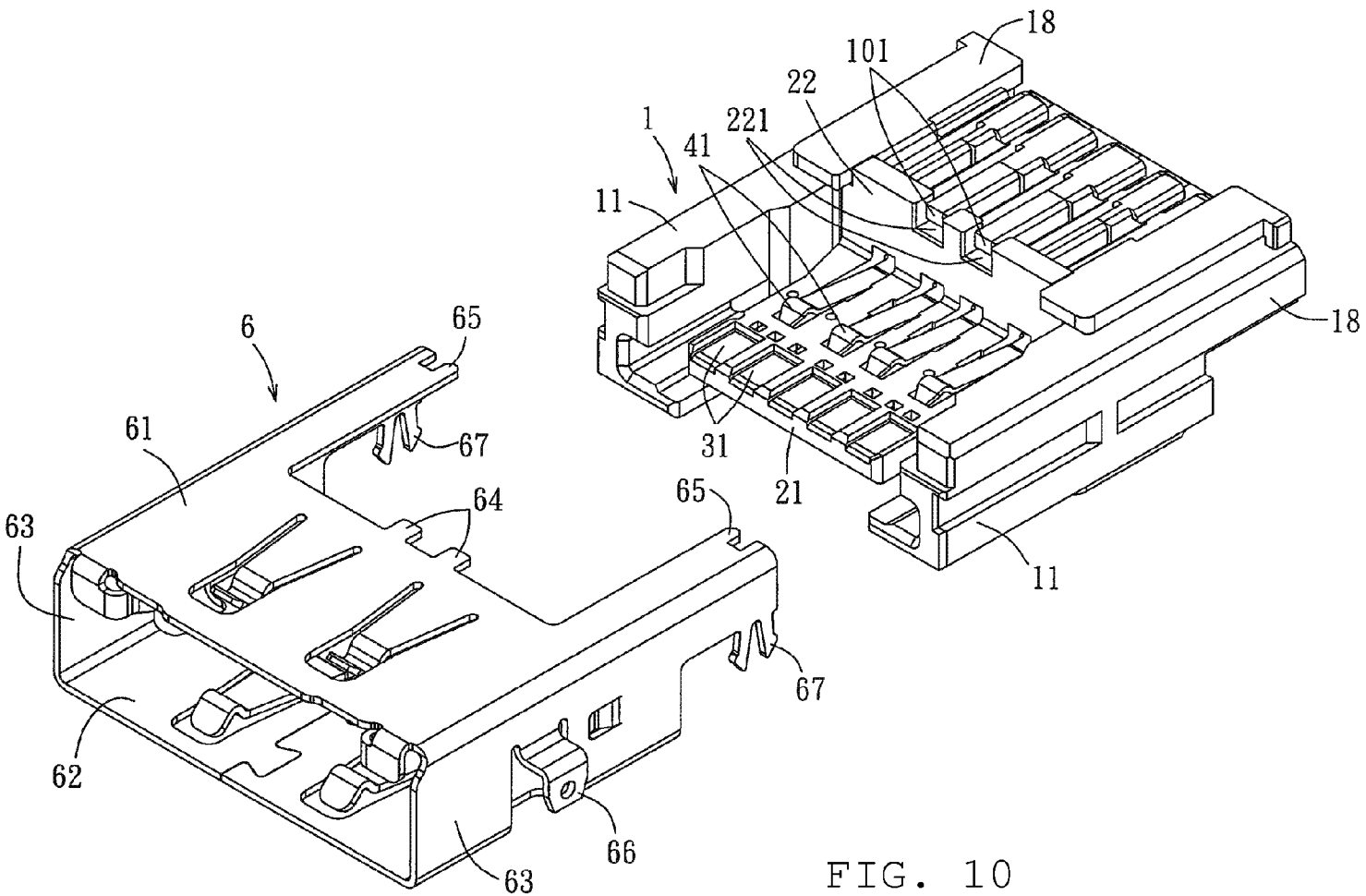
FIG. 10 and FIG. 11 are combination views of FIG. 9 and a partial perspective exploded view of a shield from a different angle.
Figure 11:
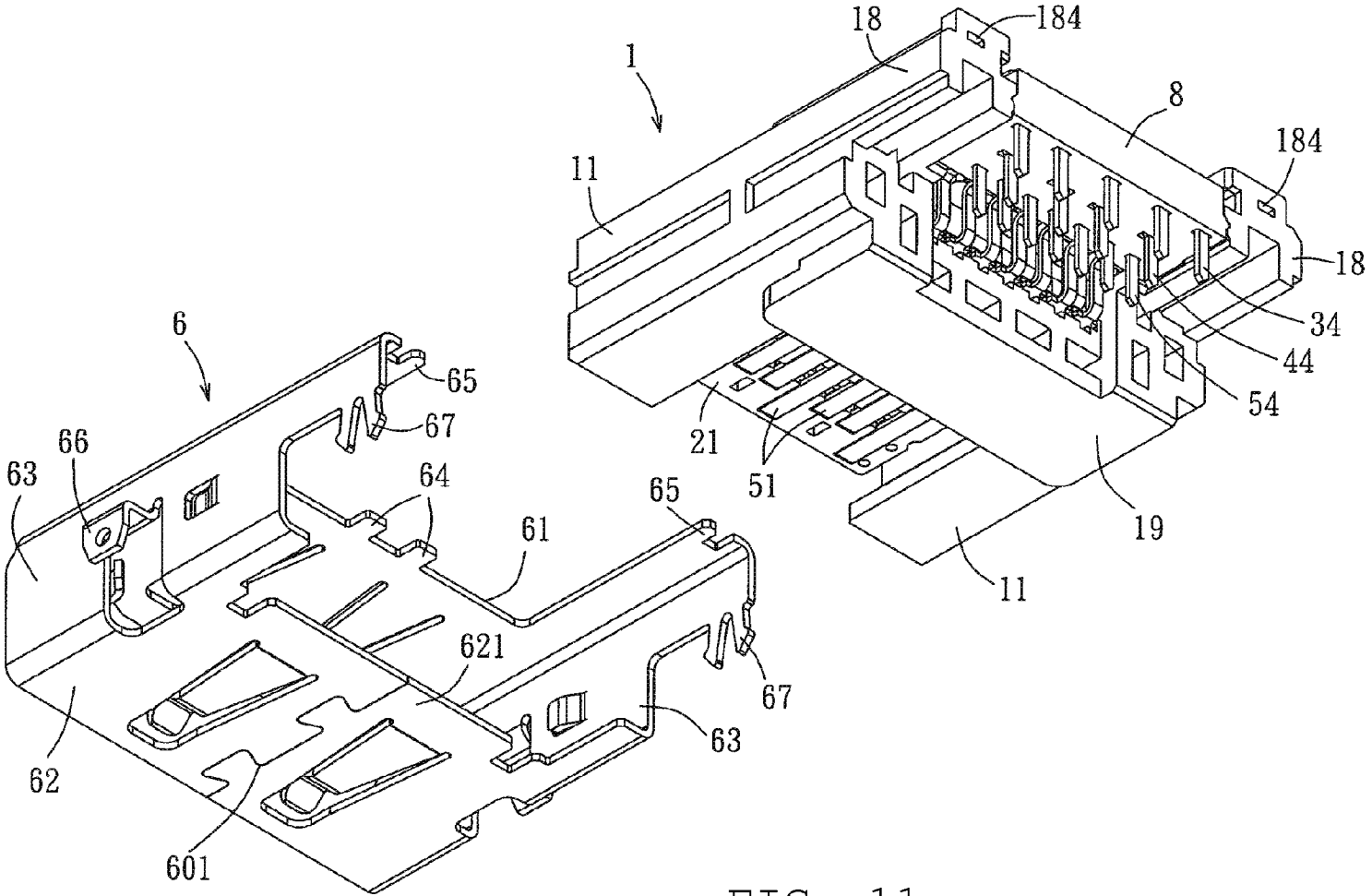
Figure 12:
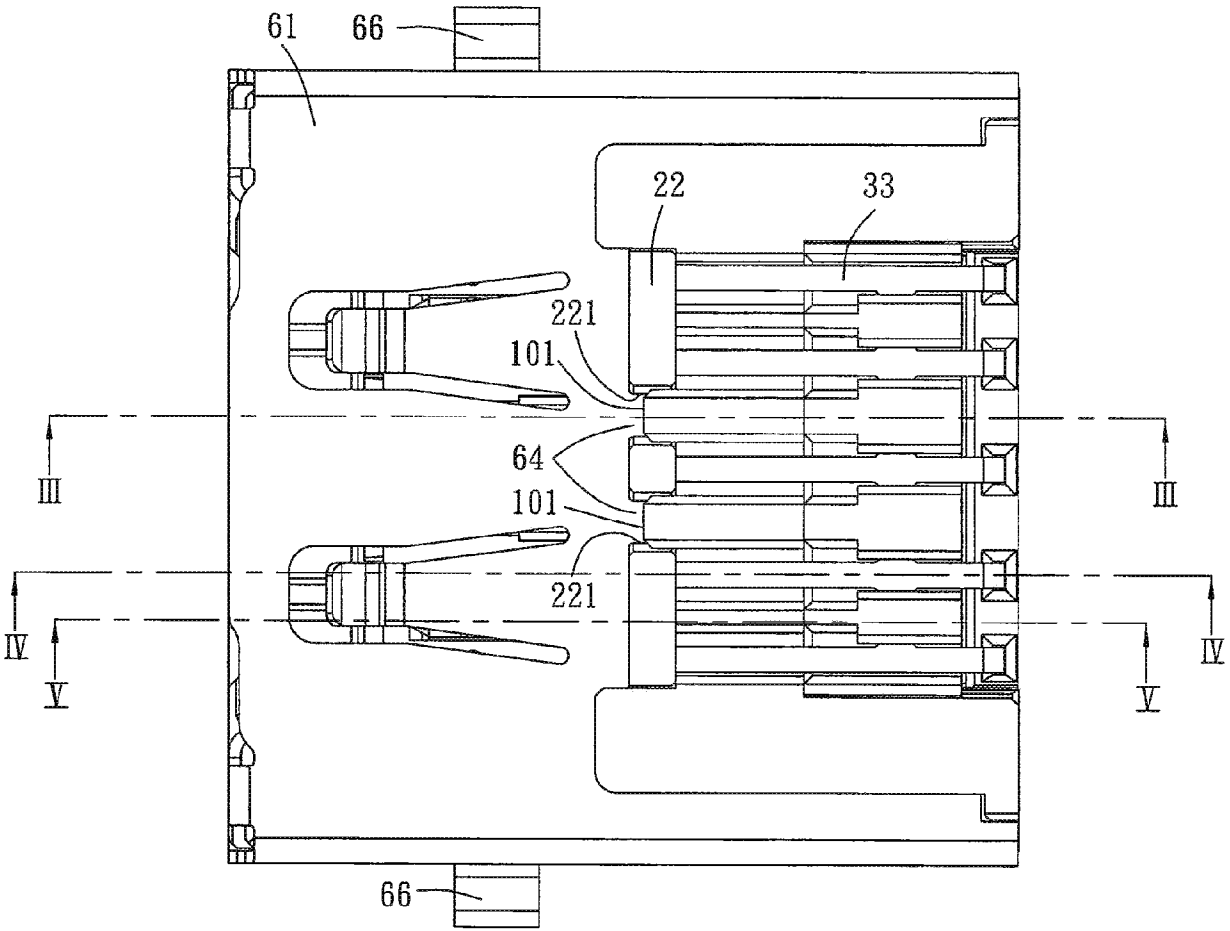
FIG. 12 is a top view of FIG. 10 after combination.
Figure 13:
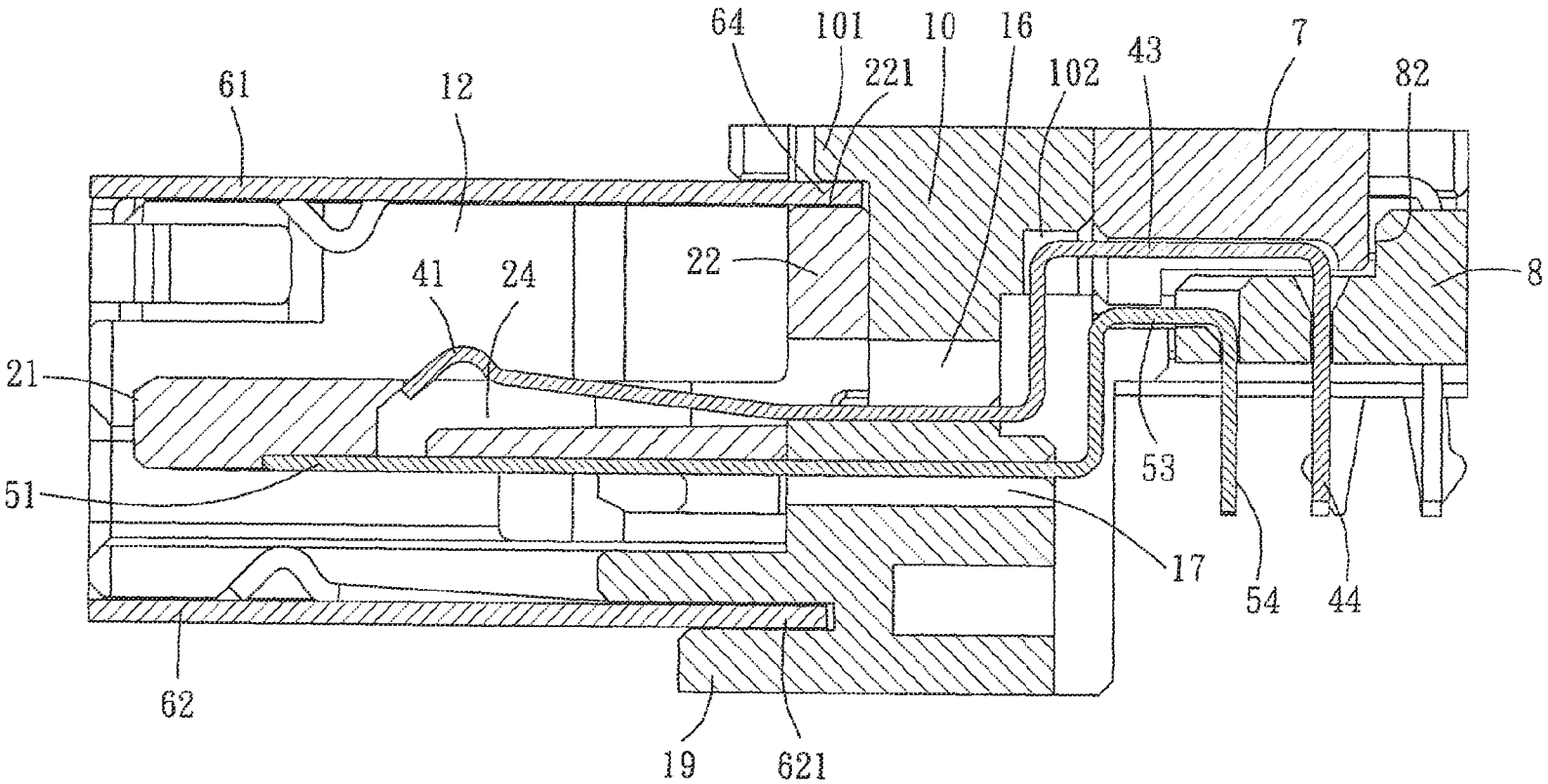
FIG. 13 is a cross-sectional view taken along III-III straight lines in FIG. 12.

Refer to FIG. 7, FIG. 8, FIG. 13, FIG. 14 and FIG. 15. First positioning part 7 has a plurality of first slot paths 71 that respectively correspond to various first extended parts 33, a plurality of second slot paths 72 that respectively correspond to various second extended parts 43, a plurality of retaining edges 73 above first slot paths 73 as well as two slide rails 74 located on the two sides. Housing 1 also comprises two rear arms 18 that respectively extend toward the rear side of base 10 from various arms 11 and rear arms 18 have slide slots 181 that are located on the inner sides and that respectively fit various slide rails 74. First positioning part 7 enters slide slots 181 by moving forward from the rear through slide rails 74, is installed on housing 1 and set against the rear side of base 10, whereas first paths 15 on the roof of housing 1 are opposite and should be connected to first slot paths 71 on the roof of first positioning part 7. Various first guide and connecting parts 34 are located on the rear side of first positioning part 7 through correspondent first slot paths 71 (first guide and connecting parts 34 are bent thereafter). The rear section of first extended parts 33 is located in first slot paths 71. In addition, various first terminals 3 also have a limiting part 35 that horizontally protrudes and extends from the first extended parts 33 corresponding to various retaining edges 73 and that are located below various retaining edges 73 (refer to FIG. 10 and FIG. 12). With this, first positioning part 7 can limit the rear section of extended parts 33 in upward, downward, left and right directions. Various extended parts 43 are located in correspondence second slot paths 72 and their shift upward and to the left and right sides can be limited by a positioning part 7.

Refer to FIG. 1, FIG. 9, 11, and FIG. 13. Second positioning part 8 has a plate body 81, a rear retaining wall 82 that protrudes and extends upward from the rear section of plate body 81, two protruding ribs 83 and sunken parts 84 that are respectively located on the left and right sides of plate body 81, a plurality of through holes 85 that are respectively and correspondingly used for threading and placement of first guide and connecting parts 34, second guide and connecting parts 44 and third guide and connecting parts 54. A clamp and fastening slot 182 and a protruding block 183 correspondence with sunken part 84 are placed in various rear arms 18 of housing 1. Second positioning 8 is installed on housing 1 from bottom to top and causes various first guide and connecting parts 34, second guide and connecting parts 44 and third guide and connecting parts 54 to be threaded and placed in corresponding through holes 85, where they are clamped and fastened mutually with clamp and fastening slot 182 and sunken part 84 and protruding block 183 through protruding ribs 83 and thereby fastened onto housing 1. In addition, second positioning part 8 is located on the lower side and rear side of first positioning part 7 and uses rear retaining wall 82 to stop first positioning part 7 from shifting backward. Second positioning part 8 is used to position various first guide and connecting parts 34, second guide and connecting parts 44 and third guide and connecting parts 54.

The aforementioned first positioning part 7 can be an integral structure with housing 1 in an embodiment with equivalent change. That is, first path 15 on the roof of housing 1 is connected to first slot paths 71 on the roof of first positioning part 7 into a slot path, in order to accommodate first extended part 33 of various first terminals 3.

Figure 19:
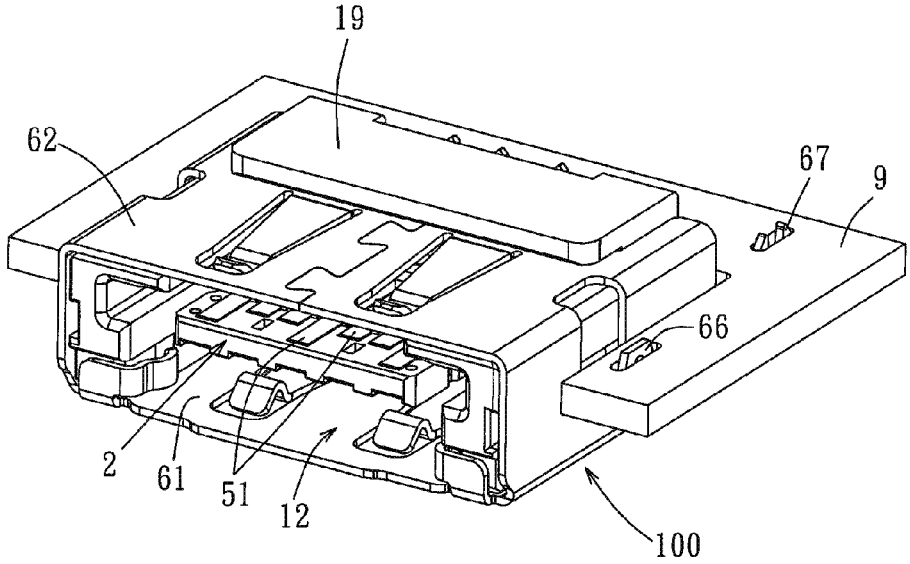
FIG. 19 is a view in the reversed direction of FIG. 2.

Refer to FIG. 2, FIG. 10, FIG. 11, FIG. 13 and FIG. 19. Enhanced wall 22 has a plurality of gaps 221 that are sunken and placed downward from the roof. Base 10 has a plurality of pressure blocks 101 that respectively protrude and extend into various gaps 221. Pressure blocks 101 are separated from the bottoms of gaps 221, shield 6 slides and is placed outside of housing 1 and has an upper wall 61 adjoining insertion space 12, a bottom wall 62 on the opposite end of upper wall 61 and two side wall 63 that are respectively connected to the two opposite sides of upper wall 61 and bottom wall 62. Shield 6 also has a plurality of first insulation pieces 64 that protrude and extend backward into various gaps 221 respectively from upper wall 61. Various first insertion pieces 64 are respectively clamped and placed between the corresponding pressure blocks 101 and the bottom of gaps 221. This not only enhances the bonding force between shield 6 and housing 1, but also causes enhanced wall 22 to be clamped and placed between shield 6 and base 10, thus further increasing the combination strength and stability of tongue unit 2 and housing 1. Shield 6 also has second insertion pieces 65 respectively located on the ends of the two sides of upper wall 61 and various rear arms 18 of housing 1 have a plug hole 184 correspondingly for plugging in various second insertion pieces 65, in order to enhance shield 6. In addition, bottom wall 62 of shield 6 has a protruding and extended part 621 that protrudes and extends backward. Housing 1 also has a protective plate 19 connected to the lower part of base 10. Protective plate 19 and base 10 clamp and hold protruding and extended part 621, which prevents shield 6 from becoming deformed in seam 601. Shield 6 also has two affixation pieces 66 and two pins 67 that are connected to two side walls 63, to be inserted into and welded to circuit board 9. As shown in FIG. 2 and FIG. 19, receptacle connector 100 in the present embodiment is installed on circuit board 9 in the form of a subsiding sheet.

As can be appreciated, therefore, tongue unit 2 in the depicted embodiment has an enhanced wall 22 that extends in a direction perpendicular to main body 21 and first fixed parts 32 of first terminals 3 are disposed between main body 21 and enhanced wall 22 in a rough L shape, thus enhancing the strength of tongue played unit 2 itself. In addition, enhanced wall 22 can be set against the base 10 and clamped and held between shield 6 and base 10, thus increasing the assembly and combination strength and stability of tongue unit 2 and housing 1.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

The invention claimed is:

1. A receptacle connector, comprising:

an housing, comprising a base and an assembly slot placed on the base;

a shield positioned around the housing and together with the housing form an insertion space;

a tongue unit, positioned in the assembly slot, the tongue unit comprising a main body and an enhanced wall; the main body having a plug-in part placed on the front and back and an assembly part combined with the assembly slot; the enhanced wall being located between the plug in part and the assembly part and extending in a direction perpendicular to the main body; the plug in part being located in the insertion space;

a first terminal set supported by the housing and the tongue unit; each of the first terminals has a first contact part that exposes the upper surface of the main body and a first fixed part that extends backward from the first contact part and whose front section is disposed within the main body and whose rear section bends and is disposed within the enhanced wall;

a second terminal set supported by the housing and the tongue unit, each of the second terminals having a second contact part that is located on the upper surface of the main body of the tongue unit to the rear of the first contact part;

a third terminal set supported by the housing and the tongue unit, each of the terminals having a third contact the part placed on the lower surface of the main body of the tongue unit.

2. The receptacle connector according to claim 1, wherein the rear side of the enhanced wall is set against the base.

3. The receptacle connector according to claim 2, wherein the enhanced wall is clamped and held between the shield and the base.

4. The receptacle connector according to claim 3, wherein the enhanced wall has a plurality of gaps that are sunken and placed downward from the roof; the base has a plurality of pressure blocks that respectively protrude and extend into various gaps; the shield has a plurality of first insulation pieces that protrude and extend backward into various gaps respectively from the upper wall and various first insertion pieces are respectively clamped and placed between the corresponding pressure blocks 101 and the bottom of gaps.

5. The receptacle connector according to claim 4, wherein the tongue unit comprises a plurality of clamp blocks placed inside the assembly part and the housing includes a plurality of clamp slots that are placed in the assembly slot to respectively accommodate various clamp blocks.

6. The receptacle connector according to claim 4, wherein the first terminal set, in support of the second terminal set, are terminal sets that are used to transmit signals that comply with the USB 3.0 signal transmission protocol; the second terminal set is a terminal set used to transmit signals that comply with USB 2.0 signal transmission protocol; the third terminal set is a terminal set used to transmit signals that comply with ESATA signal transmission protocol.

7. The receptacle connector according to claim 6, wherein the third terminal set has a total of seven third terminals 5, the three located in the middle and the left and right outer sides are grounded third terminals, two pairs of third terminals that transmit signals are respectively located between the two adjoining grounded third terminals, wherein the front end of the third contact part of the three grounded third terminals of the third terminal set protrudes forward more than the third contact part of the four remaining third terminals that transmit signals and transcends the front end of the first contact parts of the first terminals and wherein the distance of the front end of the third contact parts of the three grounded third terminals of the third terminal set from the front end surface of the tongue unit is not greater than the distance from the front end of the first contact parts to the front end surface of the tongue unit.

8. The receptacle connector according to claim 1, wherein the tongue unit includes a plurality of second terminal slots that are sunken into the upper surface of the main body and whose rear threads the enhanced wall and a plurality of third terminal slots that are sunken into the lower surface of the main body, each of the second terminal slots being connected to corresponding second paths and each of the second terminal slots being respectively located between two adjoining first fixed parts and respectively accommodating each of the second elastic contact parts, wherein each of the third terminal slots is connected to corresponding third paths and respectively that respectively accommodates the third contact parts.

9. The receptacle connector according to claim 8, wherein each of the first terminals also has a first extended part that extends backward from the first fixed part and out of the enhanced wall; each of the second terminals also has a second fixed part that extends backward from the second elastic contact part and a second extended part that extends backward from the second fixed part; each of the third terminals also has a certain fixed part that extends backward from the third contact part and the third extended part that extends backward from the third fixed part; the second extended part is located between the first extended part and the extended part.

10. The receptacle connector according to claim 9, wherein the housing includes a plurality of first paths that thread the front and back of the base, in order to correspondingly thread various first extended parts and the housing further includes a plurality of second paths that thread the front and back of the base and that are located below the first paths, in order to correspondingly thread various second terminals, and wherein a plurality of third paths that thread the front and back of the base and that are located below the second paths in order to correspondingly thread lower part of the second paths.

11. The receptacle connector according to claim 10, which also comprises a first positioning part installed on the insignificant housing and set against the rear side of the base; the first positioning part has a plurality of first slot paths that respectively correspond to various first extended parts, a plurality of second slot paths that respectively correspond to various second extended parts as well as a plurality of retaining edges located above the first slot paths; each of the first terminals also has a limiting part that horizontally protrudes and extends from the first extended parts corresponding to various retaining edges and that are located below various retaining edges.

12. The receptacle connector according to claim 11, wherein each of first terminals also has a first guide and connecting part that extends from the first extended part; each of the second terminals also has a second guide and connecting part that extends from the second extended part; each of the third terminals also has a third guide and connecting part that extends from the third extended part; the receptacle connector further comprising a second positioning part that is installed on the housing and that is located on the lower side and rear side of the first positioning part; the second positioning part having a plurality of through holes that are respectively and correspondingly used for threading and placement of the first guide and connecting parts, the second guide and connecting part and the third guide and connecting parts, the second positioning part further including a real retaining wall configured to block the first positioning part from shifting backward.

* * * * *